US008651294B2

(12) United States Patent
Mansor et al.

(10) Patent No.: US 8,651,294 B2
(45) Date of Patent: Feb. 18, 2014

(54) RAIL CONNECTOR FOR MODULAR OVERHEAD STORAGE SYSTEM

(76) Inventors: Todd Mansor, Phoenix, AZ (US); Jeff Moffat, Palm Desert, CA (US)

( * ) Notice: Subject to any disclaimer, the term of this patent is extended or adjusted under 35 U.S.C. 154(b) by 0 days.

(21) Appl. No.: 13/231,892

(22) Filed: Sep. 13, 2011

(65) Prior Publication Data

US 2012/0103923 A1 May 3, 2012

Related U.S. Application Data

(63) Continuation of application No. 12/972,278, filed on Dec. 17, 2010, now Pat. No. 8,066,131, which is a continuation of application No. 12/770,279, filed on Apr. 29, 2010, now abandoned.

(60) Provisional application No. 61/174,427, filed on Apr. 30, 2009.

(51) Int. Cl.

| | |
|---|---|
| ***A47F 5/08*** | (2006.01) |
| ***A47B 43/00*** | (2006.01) |
| ***A47B 47/00*** | (2006.01) |
| ***A47B 57/00*** | (2006.01) |
| ***D06F 57/12*** | (2006.01) |
| *A47B 45/00* | (2006.01) |
| *A47B 96/02* | (2006.01) |
| *A47B 57/44* | (2006.01) |
| *E04B 9/18* | (2006.01) |

(52) U.S. Cl.

CPC ..... *A47F 5/0892* (2013.01); *A47B 45/00* (2013.01); *A47B 96/025* (2013.01); *D06F 57/125* (2013.01); *A47B 57/44* (2013.01); *E04B 9/18* (2013.01)

USPC ..... 211/117; 211/175; 248/327; 248/343; 108/42

(58) Field of Classification Search

CPC ..... D06F 81/06; D06F 57/125; D06F 57/12; A47B 96/02; A47B 5/00; A47B 43/006; A47B 43/003; A47B 45/00; A47B 96/025; A47B 57/30; A47B 57/44; A47B 57/48; E04B 9/006; E04B 9/18; E04B 9/20; F21V 21/02; F16M 13/027; F16M 13/02; F16M 11/041; A47F 5/0892; A47F 5/10; A47F 5/13; A47F 5/0876; A47F 5/0807; A47F 5/01; A47G 25/02; A47G 25/1442; A47G 25/746; A47G 25/743; C25D 17/08; A22C 15/007

USPC ..... 211/117, 175, 204, 206, 105.3, 113, 211/208, 118, 119, 189, 207, 181.1; 248/317, 323, 326, 327, 343, 333; 108/42, 48, 149, 186; 52/39; D6/512–514, 566

See application file for complete search history.

(56) References Cited

U.S. PATENT DOCUMENTS 2,057,092 A * 10/1936 Geib ..... 182/113
3,139,045 A * 6/1964 Rojakovick ..... 108/109

(Continued)

*Primary Examiner* — Jennifer E Novosad
(74) *Attorney, Agent, or Firm* — Ronald C. Gorsche

(57) ABSTRACT

An overhead rack system is provided that may be mounted to the ceiling of a structure such as a garage for storing items in an organized manner off the floor. The overhead rack system includes a first and second adjustable mounting track and a support surface having a number of side rails connected together by a plurality of rail connectors. The first and second adjustable mounting tracks are adjustable relative to the ceiling mount such that the space between the ceiling and the support surface as well as the overall length of the side rails may be adjusted by the user according to the intended space.

14 Claims, 11 Drawing Sheets

(56) References Cited

U.S. PATENT DOCUMENTS

| | | | | |
|---|---|---|---|---|
| 3,735,951 | A * | 5/1973 | Reed | 248/340 |
| 5,520,316 | A * | 5/1996 | Chen | 224/539 |
| 6,145,678 | A * | 11/2000 | Morrison | 211/113 |
| D459,926 | S * | 7/2002 | Mikich et al. | D6/513 |
| 6,435,105 | B1 * | 8/2002 | Mikich et al. | 108/42 |
| 6,715,427 | B2 * | 4/2004 | Mikich et al. | 108/42 |
| 6,725,608 | B1 * | 4/2004 | Kraus | 52/36.4 |
| 7,255,237 | B2 * | 8/2007 | Stitchick et al. | 211/106 |
| D559,090 | S * | 1/2008 | Nawrocki | D8/373 |
| 7,357,262 | B2 * | 4/2008 | Fratilla | 211/117 |
| 7,543,538 | B2 * | 6/2009 | Baez | 108/42 |
| 7,810,438 | B2 * | 10/2010 | Ryberg | 108/42 |
| 2002/0104812 | A1 * | 8/2002 | Robichaux | 211/70.4 |
| 2004/0182291 | A1 * | 9/2004 | Mikich et al. | 108/149 |
| 2006/0070967 | A1 * | 4/2006 | Schaubeck et al. | 211/187 |
| 2007/0007223 | A1 * | 1/2007 | Thrush et al. | 211/118 |
| 2007/0119805 | A1 * | 5/2007 | Nawrocki | 211/119 |
| 2007/0205169 | A1 * | 9/2007 | Fratilla | 211/117 |
| 2012/0181240 | A1 * | 7/2012 | Crowley | 211/26 |

* cited by examiner

RAIL CONNECTOR FOR MODULAR OVERHEAD STORAGE SYSTEM

RELATED APPLICATIONS

This applications claims priority from U.S. Provisional Application No. 61/174,427, filed Apr. 30, 2009, which is hereby incorporated by reference.

FIELD OF THE INVENTION

The present invention is directed to overhead storage products that utilize unused ceiling space to create additional storage in homes. More specifically, the present invention is directed to a modular overhead storage system that utilizes an adjustable mounting track for supporting a side rail that may be sized to fit a particular construction using a rail connector.

BACKGROUND

There are many houses with a two car garage that have never had two cars in them. Instead of using that space to shield cars from the sun and harsh weather, the garage has become home to a collection of gardening and lawn equipment, tools, woodworking equipment, cast-off furniture and things that are no longer used, but are not thrown away. Finding items that are needed in a cluttered garage is a complicated process. Usually, it starts with edging between the stacks of boxes and miscellaneous equipment. If the home owner is lucky, they may remember where this particular item was last, or which box it may be located. More often, it becomes a process of elimination that involves knowing what went into the garage during which time period and playing 'hot, hot, cold' until that person stumbles upon what they're trying to locate. Overhead garage storage can transform unused space in a garage into fully functional storage space. Whether looking to store holiday decorations, sports equipment or mementos, these items can easily fit in a garage if the proper storage racks are in place.

SUMMARY

In one embodiment, an overhead storage system is provided comprising a first adjustable mounting track having a ceiling mount, a first and second upper bracket mount fixed to the ceiling mount, a first and second lower hoop members and a lower hoop support member fixed to the first and second lower hoop members and parallel to the ceiling mount. The first and second upper bracket mounts are configured to receive the first and second lower hoop members. The first and second upper bracket mounts have a plurality of holes configured to align with holes of the first and second lower hoop members to vary the distance between the ceiling mount and the lower hoop support member.

The overhead storage system of the specified embodiment also includes a second adjustable mounting track having a ceiling mount, a first and second upper bracket mount fixed to the ceiling mount, a first and second lower hoop members and a lower hoop support member fixed to the first and second lower hoop members and parallel to the ceiling mount. The first and second upper bracket mounts are configured to receive the first and second lower hoop members. The first and second upper bracket mounts have a plurality of holes configured to align with holes of the first and second lower hoop members to vary the distance between the ceiling mount and the lower hoop support member.

Continuing with the embodiment described, the overhead storage system includes a first L-shaped side rail member and a second L-shaped side rail member, each having a first rail member and a second rail member removably connected together by a rail connector. The overhead storage system includes a first L-shaped frame rail member secured to the first L-shaped side rail member and the second L-shaped side rail member and a second L-shaped frame rail member secured to the first L-shaped side rail member and the second L-shaped side rail member. The first L-shaped side rail member, second L-shaped side rail member, first L-shaped frame rail member and second L-shaped frame rail member form a support surface. A drop-in grid member is configured to rest on the support surface.

BRIEF DESCRIPTION

Figure 1:
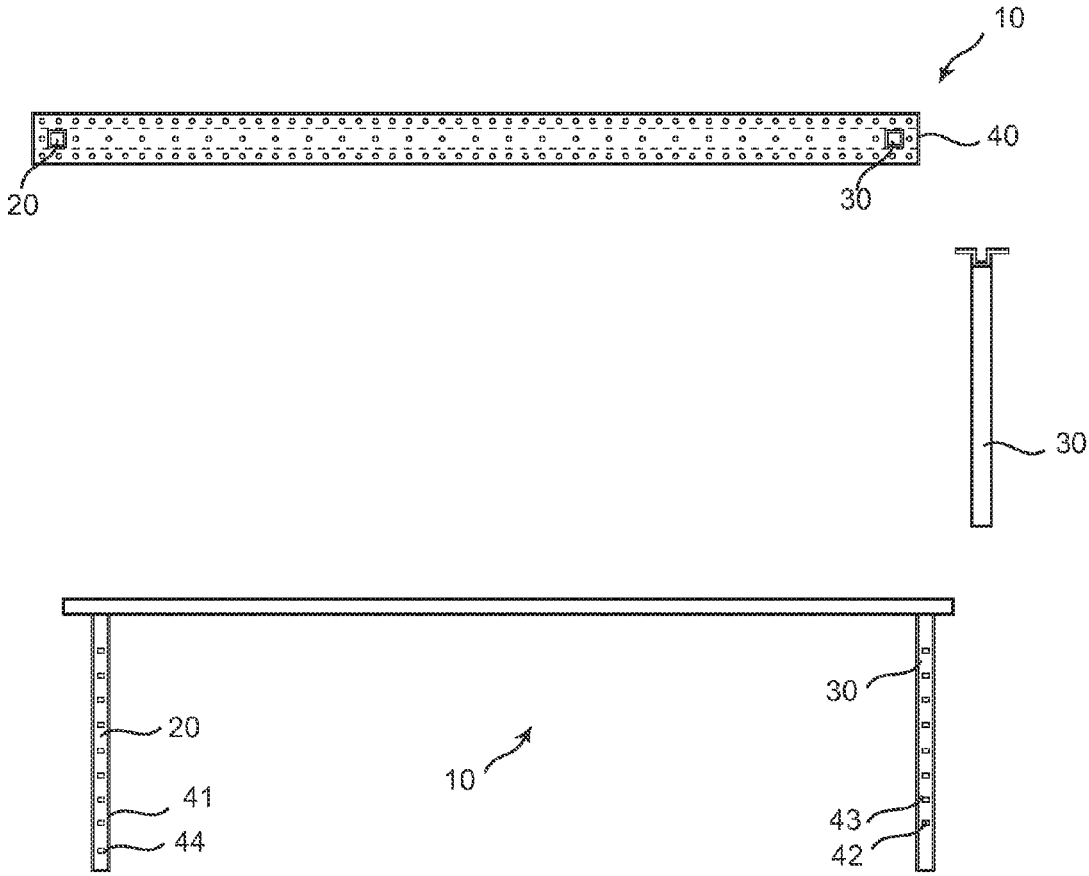
FIG. 1 shows an upper bracket mount.

FIG. 1 illustrates an upper bracket mount 10 in accordance with one aspect of the present invention. Upper bracket mount 10 is comprised of a left bracket mount member 20 and a right bracket mount member 30 and a ceiling mount 30. Left bracket mount member 20 and a right bracket mount member 30 are securely fastened to ceiling mount 30. In one embodiment, left bracket mount member 20 and a right bracket mount member 30 are welded to ceiling mount 30 to form a secure connection.

In one embodiment, ceiling mounting member 30 is configured to be secured to the ceiling of the garage. It should be appreciated that ceiling mount 30 may be attached to any surface that may be desired for mounting the modular overhead storage system.

Figure 2:
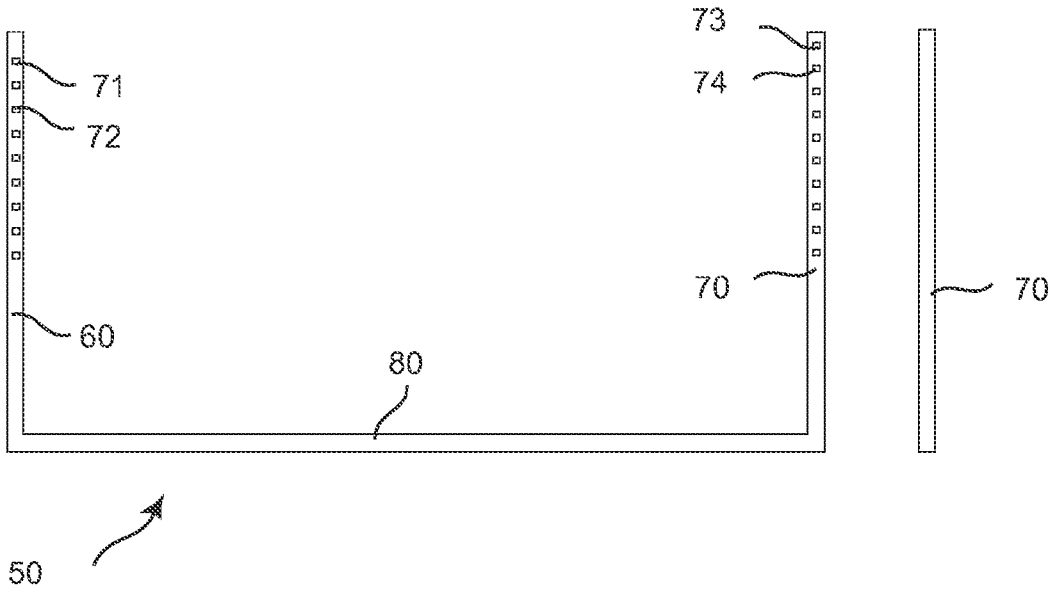
FIG. 2 illustrates a lower hoop assembly.

FIG. 2 illustrates a lower hoop assembly 50 in accordance with another aspect of the present invention. Lower hoop assembly 50 is comprised of a left lower hoop member 60, a right lower hoop member 70 and a lower hoop support member 80. Left lower hoop member 60 and right lower hoop member 70 are securely fastened to lower hoop support member 80. In the illustrated embodiment, left lower hoop member 60, right lower hoop member 70 and lower hoop support member 80 are formed of a continuous piece of material. In another embodiment, left hoop member 70 and a right bracket hoop member 30 are welded to lower hoop support member to form a secure connection.

Figure 8:
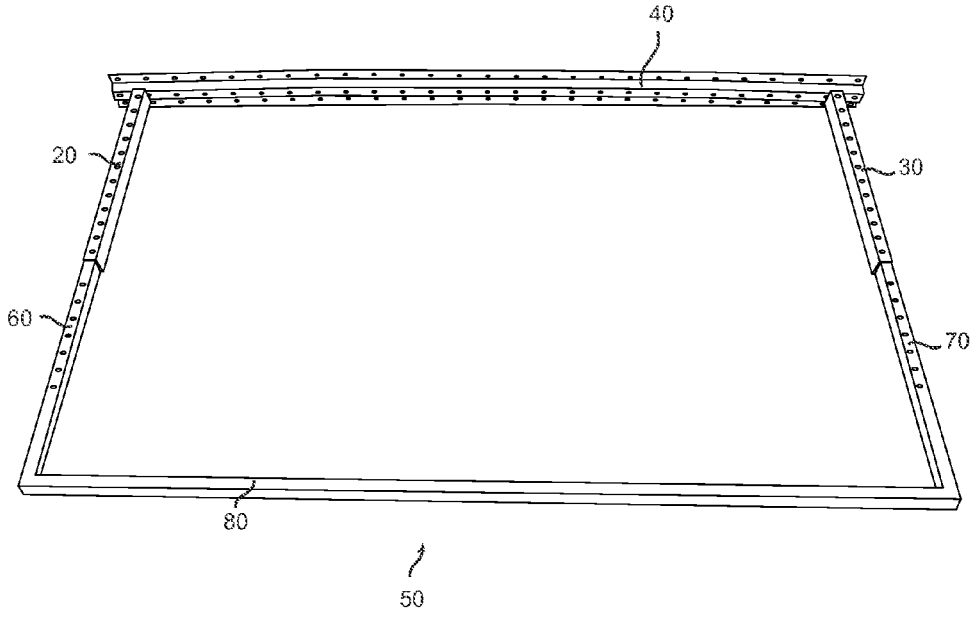
FIG. 8 shows the combination of a lower hoop and an upper bracket forming a mounting track.

In the illustrated embodiment, upper bracket mount 10 and lower hoop assembly 50 are configured to be removably joined together to form a mounting track, as shown in FIG. 8. The mounting track of the present invention forms the foundation for constructing the modular overhead storage system shown in FIG. 14.

In the illustrated embodiment, the left bracket mount member 20 and a right bracket mount member 30 and a ceiling mount 30 and the left lower hoop member 60 and right lower hoop member 70 are constructed of square tubing with a plurality of mounting holes 41, 42, 43, 44, 71, 72, 73, 74. The size of the opening in the square tubing of the left bracket mount member 20 and the right bracket mount member 30 is configured to be slightly larger than the size of the opening in the square tubing for the lower hoop member 60 and right lower hoop member 70. In this configuration, the left and right lower hoop members 60, 70 will slide into the opening of the left and right bracket mount members 20, 30 to vary the distance between the lower hoop member 60 and the ceiling mount 30. Such a configuration creates various sizing options for the mounting track between a storage surface and the ceiling of the structure.

Figure 3:
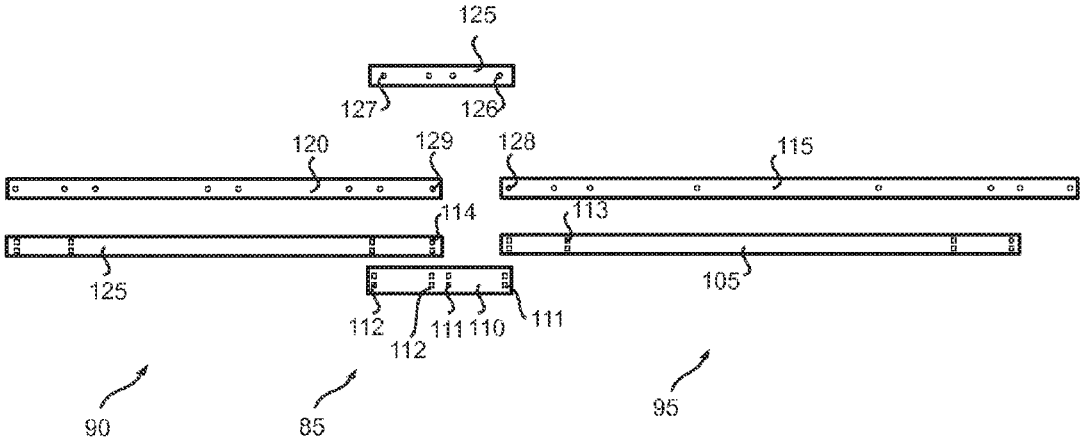
FIG. 3 illustrates a first and second universal side rail and a rail connector.

FIG. 3 illustrates a first side rail member 90, a second side rail member 95 and a rail connector 85 for securely fastening the two together so as to create a single rail member. In the illustrated example, first side rail member 90 has a length of 3 feet and second side rail member 95 has a length of four feet. Continuing with the illustrated example, the combination of the connector and the two side rail members creates a single side rail member having au overall length of 7 feet. The connector is designed such that the combination of the two pieces forming the 7 foot length is as strong and able to support the same weight as a single 7 foot piece without the connector. The first and second side rails may be of any length. The design of the side connector allows the manufacturer of the modular overhead storage system to ship varying lengths of side rail members so that the end user may create the configuration required for the particular installation.

In the embodiment illustrated FIG. 3, the first side rail member 90 has a side member 100 and a bottom member 120. The side member 100 has a plurality of side rail member holes 114. The bottom member 120 has a plurality of bottom rail member holes. The rail connector 85 has a side rail connector member 110 and a bottom rail connector member 125. The side rail connector member 110 has a plurality of side rail connector member holes 111, 112. The bottom rail connector member 125 has a plurality of bottom rail connector member holes 126, 127.

When assembled, first rail member 90 is configured to be attached to second rail member 95 using connector 85. More specifically, the plurality of side rail member holes 114 of side member 100 are configured to align with the side rail connector member holes 112 of the side 110 of rail connector 85. Similarly, the plurality of side rail member holes 113 of side member 105 are configured to align with the side rail connector member holes 111 of the side 110 of rail connector 85. On the bottom, the plurality of bottom rail member holes 129 of bottom rail member 120 are configured to align with the bottom rail connector member holes 127 of the bottom 125 of the rail connector 85. Similarly, the plurality of bottom rail member holes 128 of bottom rail member 115 are configured to align with the bottom rail connector member holes 126 of the bottom 125 of the rail connector 85. The connector 85 may be fixed to the first and second rail members 90, 95 using a nut and bolt combination fit through the aligned holes. It should be appreciated by one of ordinary skill in the art that any suitable fixing method may be used without departing from the intended scope of the present invention.

Figure 4:
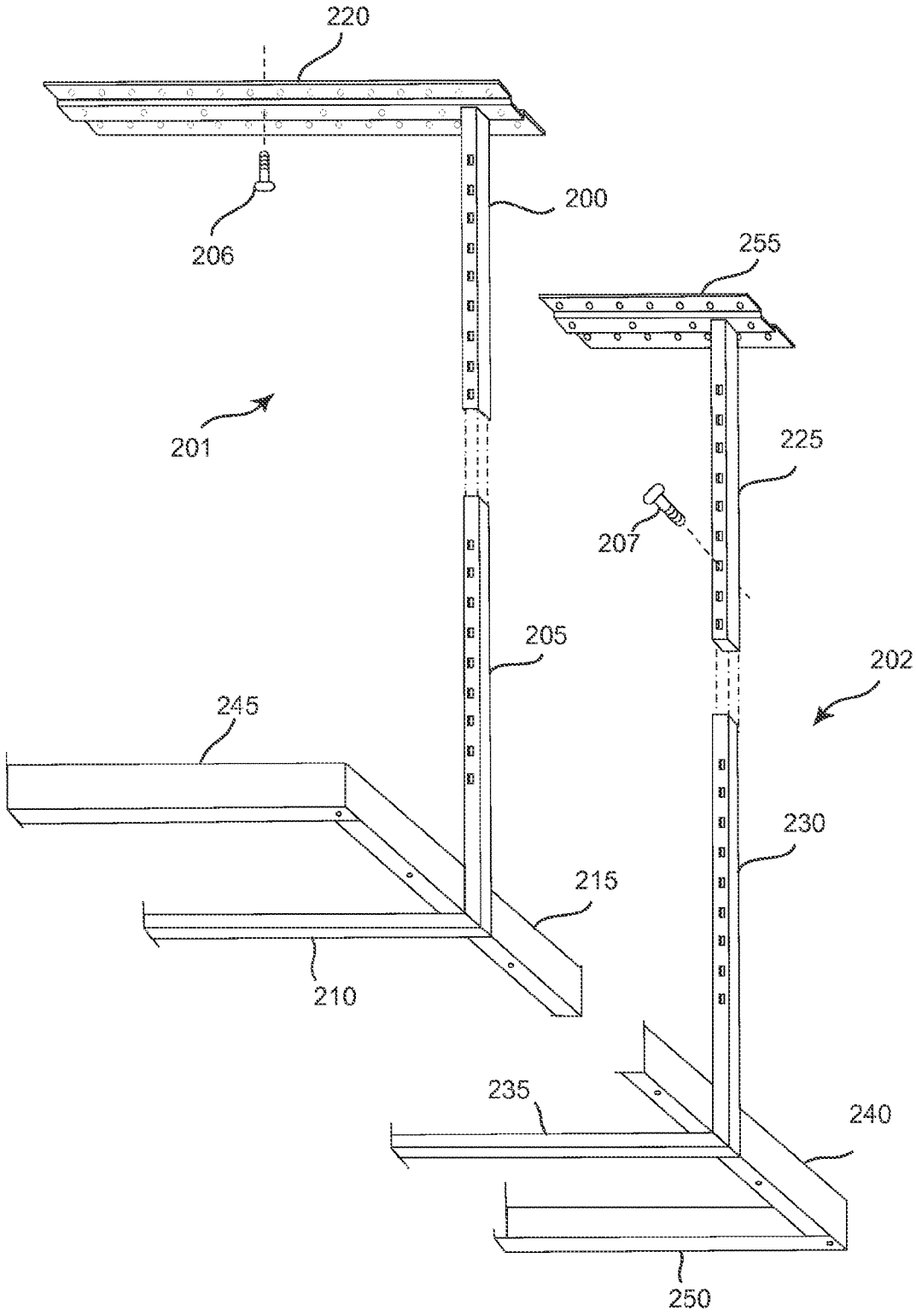
FIG. 4 shows a typical construction of a modular overhead storage system in accordance with one aspect of the present invention.

FIG. 4 illustrates a typical construction of a modular overhead storage system in accordance with one aspect of the present invention having a first mounting track 201 and a second mounting track 202 and a rail member 203. In the illustrated embodiment, the first mounting track is comprised of a ceiling mount 220 secured to an upper bracket member 200, a lower hoop member 205 and a lower hoop support member 210. The second mounting track is comprised of a ceiling mount 255 secured to an upper bracket member 225, a lower hoop member 230 and a lower hoop support member 235. The rail member 203 is comprised of a side rail 215 and a first frame rail 245 and a second frame rail 250. The side rail may be constructed of two side rail members connected together by a side rail connector (not shown). The rail member 203 is sized to fit within the first and second mounting tracks 201, 202 such that the mounting tracks "cradle" the rail member 203. In the illustrated embodiment, the ceiling mount 220 is secured to ceiling joists using one or more lag bolts 206 and the upper bracket member 200 is secured to the lower hoop member 205 using one or more carriage bolts 207.

Figure 5:
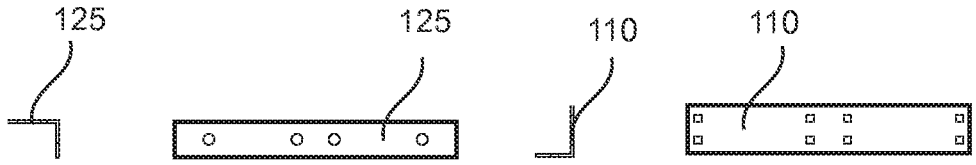
FIG. 5 shows one embodiment of a rail connector.

FIG. 5 shows one embodiment of the rail connector 85 in greater detail. Rail connector 85 has a side 110 and a bottom 125 with a plurality of holes disposed in each. The holes on the rail connector 85 are configured to attach a first side rail member to a second side rail member to create a single joined rail member that is designed to withstand the loads of a single rail member. In the illustrated embodiment, the load rating of the modular overhead storage system using the rail connector 85 is at least 750 lbs.

Figure 6:
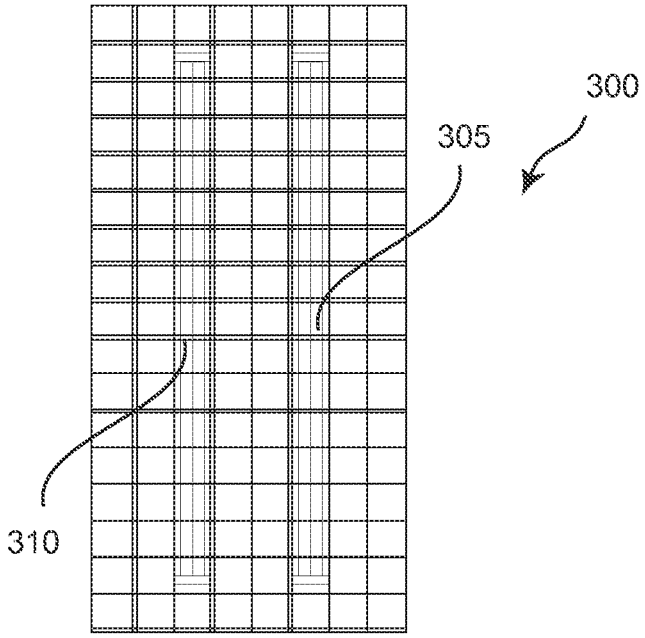
FIG. 6 illustrates a typical drop-in grid having grid stiffeners.
Figure 7:
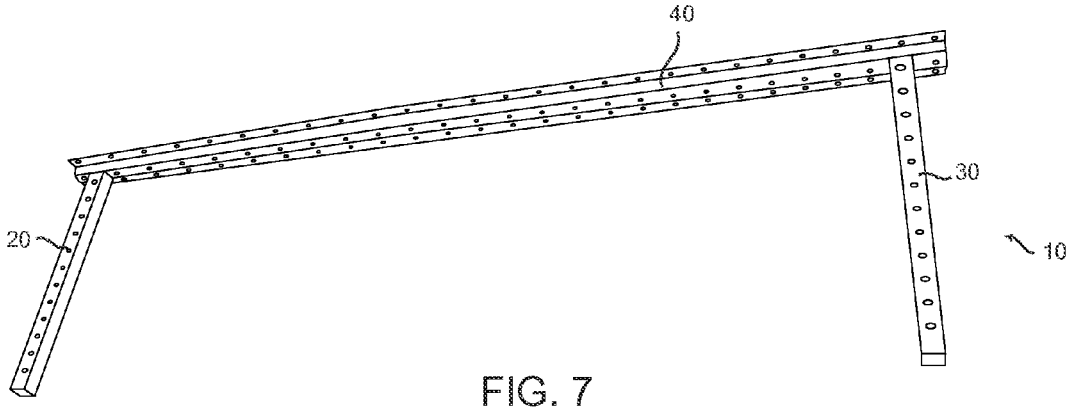
FIG. 7 illustrates one embodiment of a square tube upper bracket.

FIG. 6 shows the drop-in grid member 300 with a plurality of grid stiffeners 305, 310. Drop-in grid 300 is configured to be attached to rail member 203 so as to provide the surface for storing items. Drop-in grid is illustrated with a grid construction, however, one of ordinary skill in the art will appreciate that any suitable construction may be used for the item storage surface without departing from the scope and spirit of the present invention.

In the illustrated example of the modular overhead storage system shown in the photos of FIGS. 7-15, FIG. 7 shows the ceiling mount 40 of the upper bracket mount 10 fastened to the ceiling of a garage. Upper bracket 10 is comprised of a square tubed first and second mounting bracket 20, 30 for receiving the lower hoop 50. As shown in FIG. 8, the square tubed left and right lower hoop members 60, 70 of the lower hoop 50 slide within the square tubed first and second mounting bracket 20, 30 and fixed together by a plurality of carriage bolts. The combination of the upper bracket mount 10 and the lower hoop 50 together form the mounting track. The illustrated example uses square tubes to form the members, however, one of ordinary skill in the art will appreciate that alternate shapes of tubes may be used without departing from the intended scope of the invention.

Figure 9:
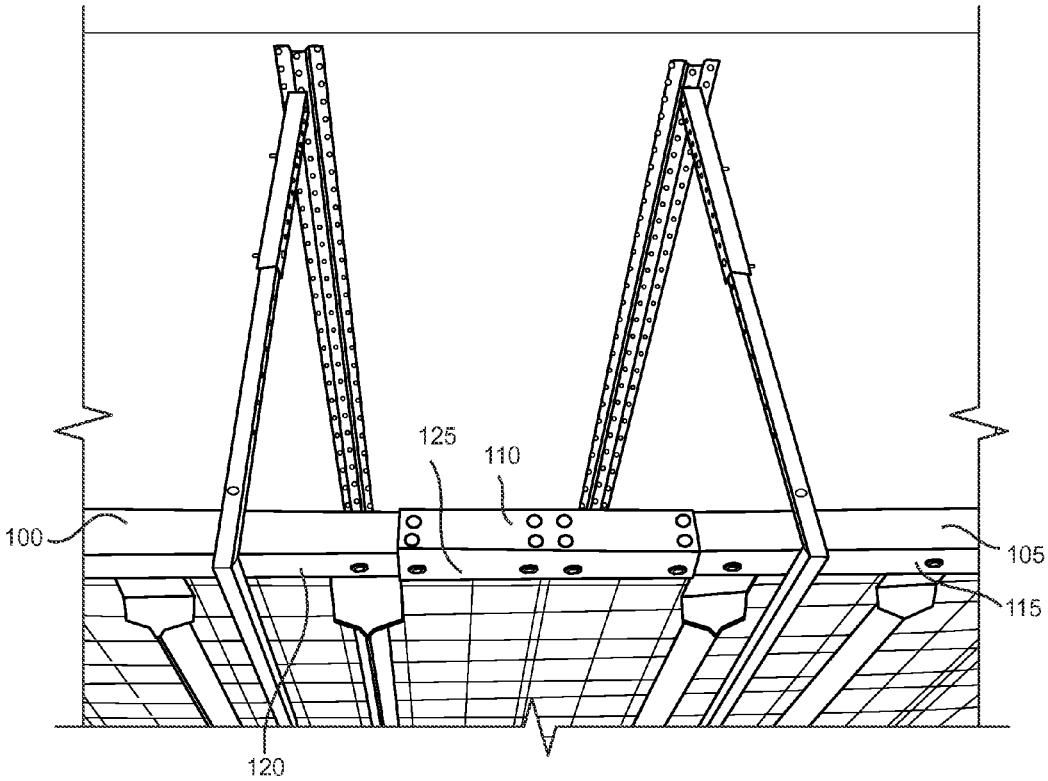
FIG. 9 shows one embodiment of a modular overhead storage system having a plurality of mounting tracks supporting a first and second universal side rail and a rail connector joined together by a rail connector.
Figure 10:
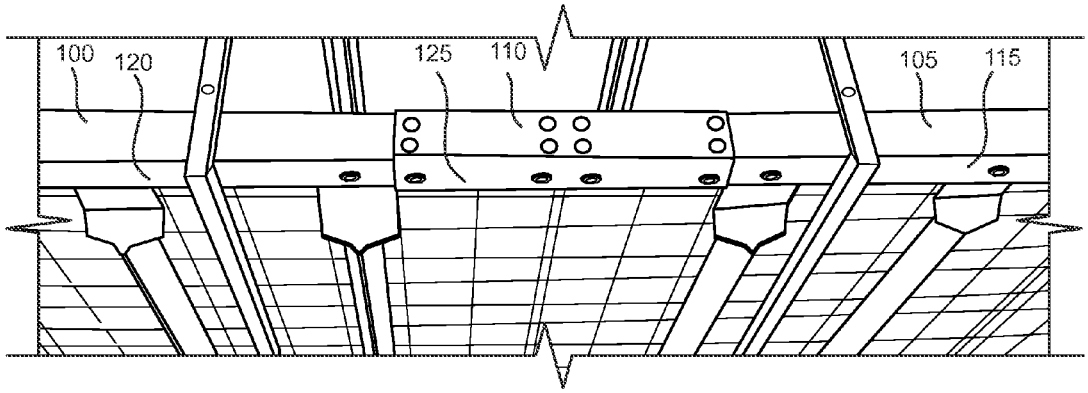
FIG. 10 illustrates the same modular overhead storage system of FIG. 9, showing the rail connector in greater detail.

FIGS. 9 and 10 show the combination of a side rail member and two mounting tracks. In the illustrated embodiment, the side rail member is comprised of a first side rail member 90 securely fixed to a second side rail member 95 using a rail connector 85. FIG. 9 shows the side 110 of the rail connector 85 and the sides 100, 105 of the first and second side rails 90, 95 respectively. FIG. 10 illustrates the bottom 125 of the rail connector 85 and the bottoms 115, 120 of the first and second side rails 90, 95 respectively. In one embodiment, the drop-in grid 300 is supported on all four sides by the bottoms 115, 120 of the first and second side rails 90, 95 respectively and the grid stiffeners 305, 310 are secured to the bottoms of the side rails.

Figure 11:
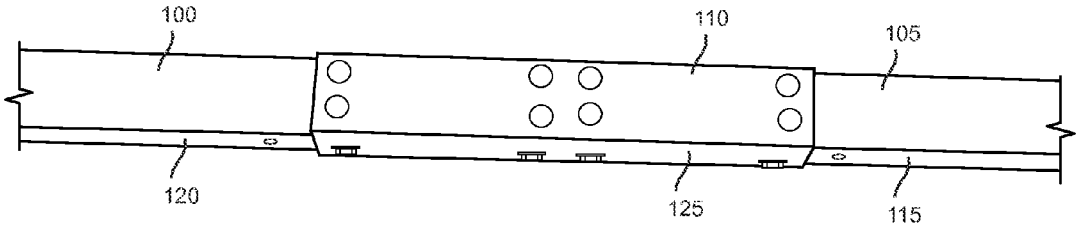
FIG. 11 illustrates one embodiment of the two side rails joined together by a rail connector.
Figure 12:
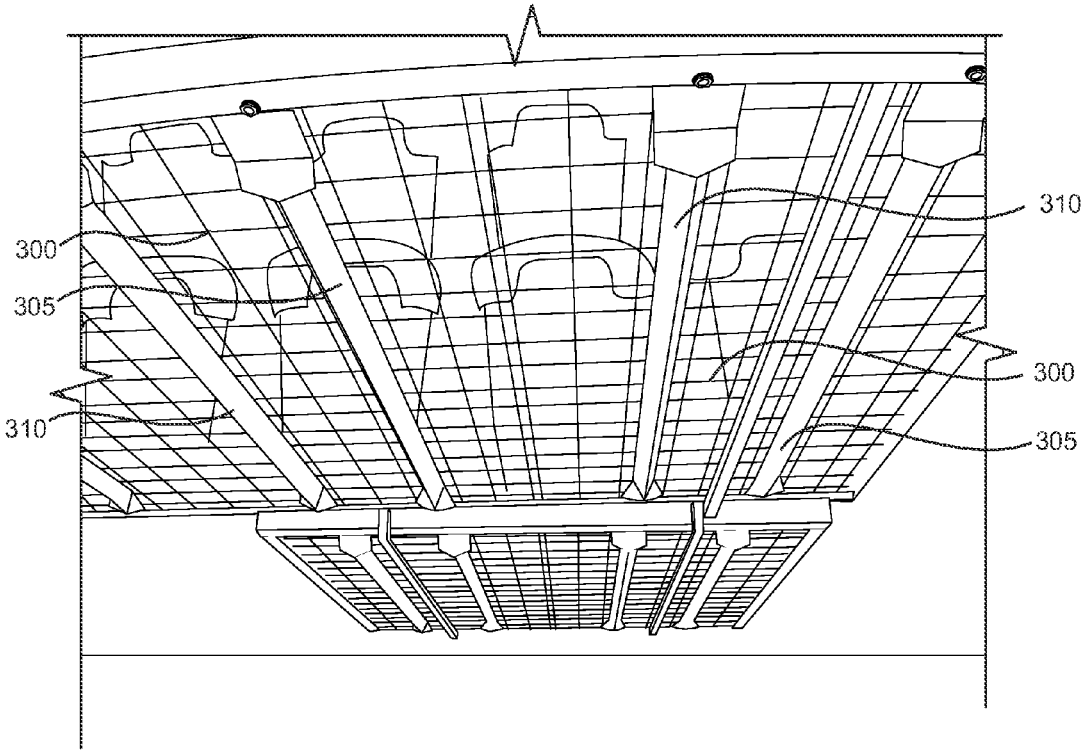
FIG. 12 shows one configuration of a number of drop-in grid members for an installed modular overhead storage system.

FIG. 11 shows a close up view of an installation having a first side rail member 100 securely attached to a second side rail member 105 using a rail connector 110. The first and second side rail members 100, 105 are shaped like an "L" to create a channel for supporting the drop-in grid member. As shown in FIG. 12, the drop-in grid member 300 rests within the L-shaped side rail members and the grid stiffeners are secured to the side rail members for additional security.

Figure 13:
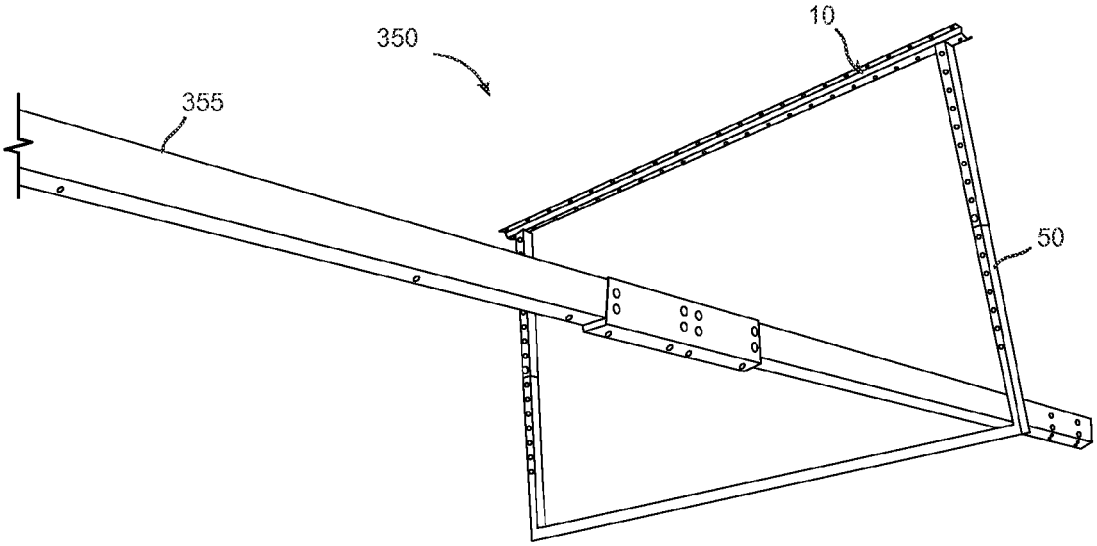
FIG. 13 illustrates the assembly of a mounting track and a side rail member comprising two side rails joined together by a rail connector.

FIG. 13 shows a mounting track 350 supporting a rail member 355. As shown previously, adjustable mounting track 350 is comprised of an upper bracket mount 10 and a lower loop 50. Typically, the adjustable mounting track is adjustable between from 18" to 36" to account for the vehicle within the garage. However, one skilled in the art will understand that distance may be varied for higher joists without departing from the scope of the present invention. In the illustrated embodiment, rail member 355 is an "L" shaped member having a first rail member 90 and a second rail member 95 connected together by a rail connector 85. Multiple rail members and mounting tracks may be used depending upon the configuration of the location.

Figure 14:
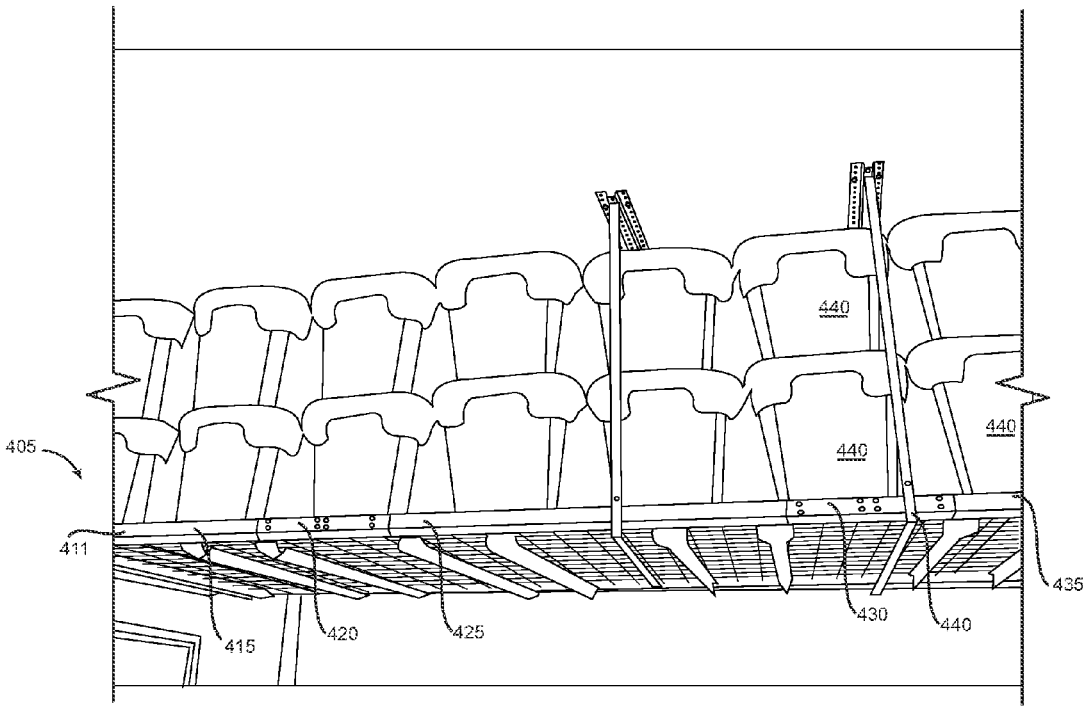
FIG. 14 illustrates a one embodiment of a modular overhead storage system supporting a number of items.
Figure 15:
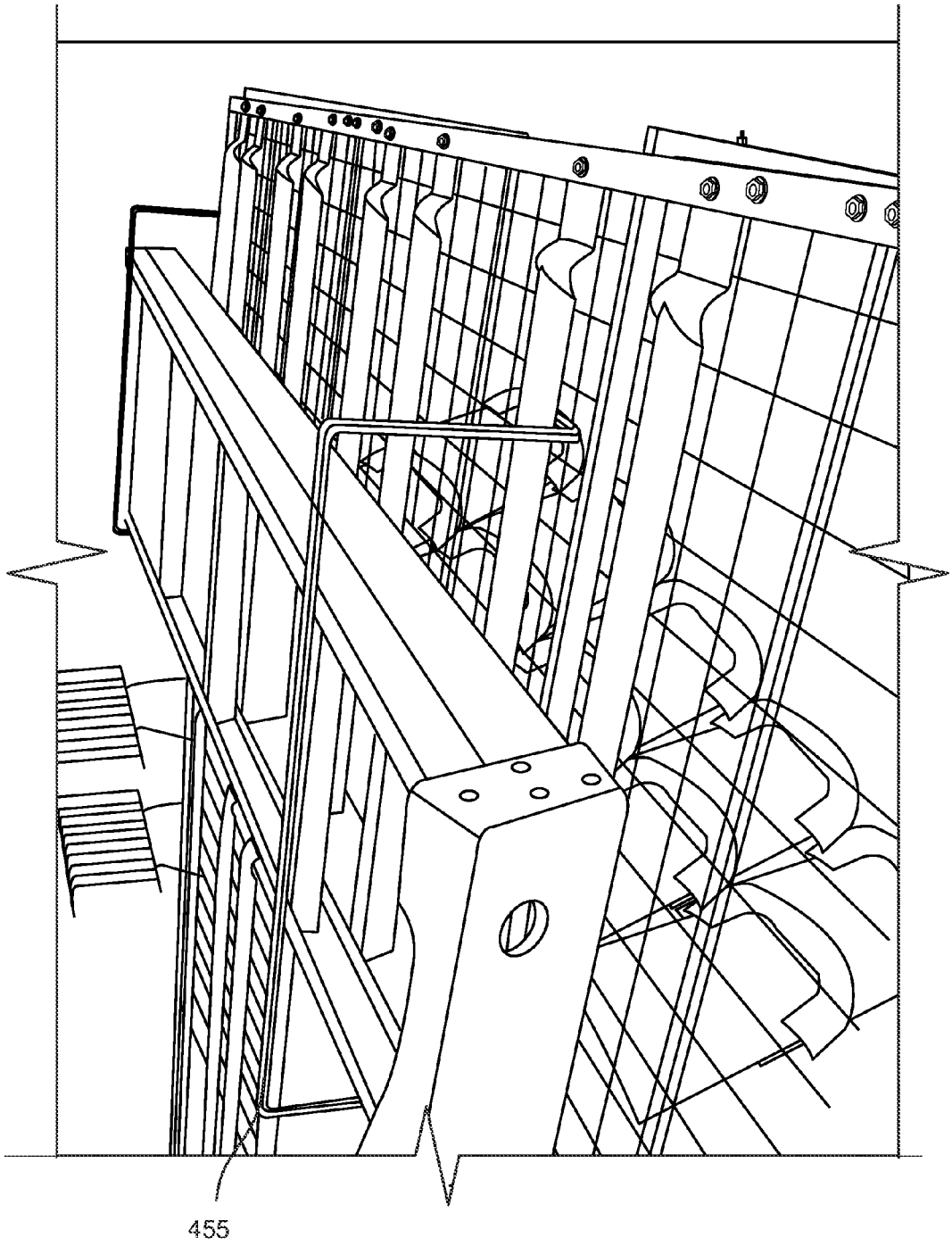
FIG. 15 shows a modular overhead storage system having a ladder hanger.

FIG. 14 shows one particular example of a modular overhead storage system in accordance with the present invention. The modular overhead storage system 405 is comprised of a number of mounting tracks 400, 410 (others are not shown in the figure) and a multi-sectioned rail member 411. Multi-sectioned rail member 411 is comprised of rail sections 415, 425, 435 joined together by rail connectors 420, 430. Drop-in grid 300 is supported by the "L" shape of the multi-sectioned rail member 411 and secured by fastening the grid stiffeners 305, 310 to the rail member. Items 440 rest on top of the drop-in grid 300. As shown in FIG. 15, hooks or ladder hangers may be attached to the drop-in grid to allow additional storage.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects.

While the invention has been particularly shown and described with reference to various embodiments thereof, it will be understood by those skilled in the art that various other changes in the form and details may be made without departing from the spirit and scope of the invention.

We claim:

1. A support surface frame for a modular overhead storage system comprising:

a first side rail member comprised of a first rail member adjacent to and abutting a second rail member, said first and second rail members each having a front face, wherein said front face of each rail member has at least one hole therein, said first and second rail members removably coupled together by a first rail connector sized to overlap said first and second rail members where the rail members touch, wherein each rail connector has a front face having a plurality of holes therein, and wherein, for each side rail member, said at least one hole in the front face of each rail member is configured to align with one or more holes of said plurality of holes in the front face of said rail connector;

a second side rail member comprised of a third rail member adjacent to and abutting a fourth rail member, said third and fourth rail members each having a front face, wherein said front face of each rail member has at least one hole therein, said third and fourth rail members removably coupled together by a second rail connector sized to overlap said third and fourth rail members where the rail members touch, wherein each rail connector has a front face having a plurality of holes therein, and wherein, for each side rail member, said at least one hole in the front face of each rail member is configured to align with one or more holes of said plurality of holes in the front face of said rail connector;

a first frame rail member having a front face shaped substantially similar to the first and second side rail members, a proximal end of said first frame rail member adjacent, abutting and secured to said first side rail member, and a distal end of said first frame rail member adjacent, abutting and secured to said second side rail member;

a second frame rail member having a front face shaped substantially similar to the first and second side rail members, a proximal end of said second frame rail member adjacent, abutting and secured to said first side rail member and a distal end of said first frame rail member adjacent, abutting and secured to said second side rail member wherein the first side rail member, second side rail, member, first frame rail member and second frame rail member together form the substantially rectangular shaped support surface frame configured to support one or more grid members positioned thereon; and at least one mounting track coupled to said support surface frame for securing the modular overhead rack system to one or more ceiling joists of a structure.

2. The support surface frame of claim 1, further comprising a drop-in grid member configured to rest on the support surface frame.

3. The support surface of claim 2, wherein said first side rail member, second side rail member, first frame rail member and second frame rail member are L-shaped.

4. The support surface of claim 1, wherein said first and second rail connectors are designed such that a said modular overhead storage system may be shipped with varying lengths of said side rail members, and wherein an end user creates a configuration for a particular installation.

5. A method of providing a support surface for a modular overhead storage system comprising:

providing a first rail member adjacent to and abutting a second rail member, said first and second rail members each having a front face and a frame support, wherein said front face of each rail member has at least one hole therein and said frame support of each rail member has at least one hole therein;

coupling said first rail member and said second rail member using a first rail connector sized to overlap said first and second rail members where the rail members touch to form a first side rail member, wherein each rail connector has a front face having a plurality of holes therein and a frame support having a plurality of holes therein, and wherein, for each side rail member, said at least one hole in the front face of each rail member is configured to align with one or more holes of said plurality of holes in the front face of said rail connector and said at least one hole in the frame support of each rail member is configured to align with one or more holes of said plurality of holes in the frame support of said rail connector;

providing a third rail member adjacent to and abutting a fourth rail member, said third and fourth rail members each having a front face and a frame support, wherein said front face of each rail member has at least one hole therein and said frame support of each rail member has at least one hole therein;

coupling said third rail member to said fourth rail member using a second rail connector sized to overlap said third and fourth rail members where the rail members touch to form a second side rail member, wherein each rail connector has a front face having a plurality of holes therein and a frame support having a plurality of holes therein, and wherein, for each side rail member, said at least one hole in the front face of each rail member is configured to align with one or more holes of said plurality of holes in the front face of said rail connector and said at least one hole in the frame support of each rail member is configured to align with one or more holes of said plurality of holes in the frame support of said rail connector;

securing a first frame rail member to the first side rail member and the second side rail member;

securing a second frame rail member to the first side rail member and the second side rail member, wherein the first side rail member, second side rail member, first frame rail member and second frame rail member together form the support surface frame; and securing a drop-in grid member to the support surface frame.

6. A support surface frame for a modular overhead storage system comprising:

a first side rail member comprised of a first rail member adjacent to and abutting a second rail member removably coupled together by a first rail connector, said first and second rail members each having a front face and a frame support, said first rail connector sized to overlap said first and second rail members at the point the rail members touch, said first rail connector configured to be removably coupled to said first and second rail members;

a second side rail member comprised of a third rail member adjacent to and abutting a fourth rail member removably coupled together by a second rail connector, said third and fourth rail members each having a front face and a frame support, said second rail connector sized to overlap said third and fourth rail members at the point the rail members touch, said second rail connector configured to be removably coupled to said third and fourth rail members;

a first frame rail member secured to the first side rail member and the second side rail member;

a second frame rail member secured to the first side rail member and the second side rail member, wherein the first side rail member, second side rail member, first frame rail member and second frame rail member together form the support surface frame; and at least one mounting track coupled to said support surface frame for securing the modular overhead rack system to one or more ceiling joists of a structure, wherein said front face of each rail member has at least one hole therein and said frame support of each rail member has at least one hole therein, wherein each rail connector has a front face and a frame support, said front face of each rail connector having a plurality of holes therein and said frame support of each rail connector having a plurality of holes therein, wherein, for each side rail member, said at least one hole in the front face of each rail member is configured to align with one or more holes of said plurality of holes in the front face of said rail connector, and wherein, for each side rail member, said at least one hole in the frame support of each rail member is configured to align with one or more holes of said plurality of holes in the frame support of said rail connector.

7. The support surface frame of claim 6, wherein said first rail connector is sized to overlap said first and second rail members on said front face and said first rail connector is configured to be removably coupled to at least the front face of said first and second rail members, and wherein said second rail connector is sized to overlap said third and fourth rail members on said front face and said second rail connector is configured to be removably coupled to at least the front face of said third and fourth rail members, and wherein said first rail connector has a front face and a frame support and is shaped like the first and second rail members, and wherein said second rail connector has a front face and a frame support and is shaped like said third and fourth rail members.

8. The support surface frame of claim 7, wherein said first rail connector is removably coupled to the first and second rail members using a nut and bolt assembly, and wherein said second rail connector removably coupled to the third and fourth rail members using a nut and bolt assembly.

9. The support surface frame of claim 8, wherein said rail connectors, said rail members and said frame rail members are L-shaped.

10. The support surface frame of claim 6, further comprising a drop-in grid member configured to rest on the support surface frame.

11. The support surface of claim 6, wherein said first and second rail connectors are of a sufficient size and strength such that a said modular overhead storage system may be shipped with varying lengths of said side rail members, and wherein an end user creates a configuration of the first and second side rail members for a particular installation.

12. The support surface frame of claim 6, wherein said first rail connector is shaped like the first and second rail members, and wherein said second rail connector is shaped like said third and fourth rail members.

13. The support surface frame of claim 6, wherein said mounting track further comprises an upper bracket member and a lower hoop assembly each constructed of a square tube material, said lower hoop assembly configured to fit within the interior of the upper bracket member and move in a telescoping manner relative thereto, wherein the telescoping movement allows the distance between the ceiling joists of the structure and the support surface frame to vary.

14. The support surface frame of claim 13, wherein said lower hoop assembly further comprises a lower hoop member connected to a lower hoop support member, wherein said support surface frame contacts a surface of said lower hoop support member and said lower hoop support member supports said support surface frame.

* * * * *